US005379179A

United States Patent [19]

Graves

[11] Patent Number: 5,379,179

[45] Date of Patent: Jan. 3, 1995

[54] LOCKING CONTAINER FOR HAND WEAPON

[76] Inventor: David A. Graves, 3631 E. 55th St., Tulsa, Okla. 74135

[21] Appl. No.: 98,505

[22] Filed: Jul. 28, 1993

[51] Int. Cl.[6] ..... A41D 19/00

[52] U.S. Cl. ..... 361/232; 2/16; 2/158; 42/1.08; 42/70.01

[58] Field of Search ..... 34/225, 226, 230, 231, 34/232, 235; 89/1.4, 1.11; 42/1.08, 70.01; 361/191; 2/16, 158, 159, 160, 161.6

[56] References Cited

U.S. PATENT DOCUMENTS

| | | | |
|---|---|---|---|
| 4,089,195 | 5/1978 | Lai | 361/232 |
| 4,370,676 | 1/1983 | Darrell | 361/232 |
| 4,688,140 | 8/1987 | Hammes | 361/232 |
| 4,977,625 | 12/1990 | Charters, III | 2/170 |
| 5,088,121 | 2/1992 | Wallace | 2/158 |

*Primary Examiner*—Jeffrey A. Gaffin
*Attorney, Agent, or Firm*—Catalano, Zingerman & McKay

[57] ABSTRACT

A locking container for a hand weapon comprising a longitudinally extending container having an open end and an opposite closed end, a transverse plate mounted at the closed end of the container, a hand weapon mounted within the container and connected to the transverse plate by means of a bracket. The hand weapon is provided with a discharge end adapted to be utilized against an assailant, and the transverse plate is provided with an opening cooperating with the discharge end of the hand weapon whereby the discharge end can be directed against the assailant. The open end of the container is capable of receiving a hand of a user of the hand weapon such that the hand can be inserted into the container to grasp the hand weapon and so as to position a finger of the hand against a trigger of the hand weapon. A locking device is mounted on the open end of the container for encircling the wrist of the user in order to lock the hand within the container and thereby prevent an assailant from taking the hand weapon away from the user.

17 Claims, 7 Drawing Sheets

LOCKING CONTAINER FOR HAND WEAPON

BACKGROUND OF THE INVENTION

1. Field of the Invention

The present invention relates to a locking container for a hand weapon. More particularly, the locking container of the present invention is adapted to include a hand weapon, such as a stun gun or mace spray, which is mounted in a fixed position within the container; when the hand of the wearer is inserted into the container to grasp the weapon, the container can be adjusted to a locked position against the wrist of the wearer so that the weapon is out of the reach or grasp of an assailant.

2. Description of the Related Art

Crime awareness and crime prevention are very much on the minds of many people today. Self protection is also an important aspect of this crime prevention. To this end, many people carry stun guns, mace containers and other liquid repellant containers in their pockets or purses to be used against a possible assailant. However, it occasionally happens that the assailant will take the stun gun or mace spray away from the user with very unhappy results.

The purpose of the present invention, therefore, is to provide a locking container which will permit a user to carry a stun gun or a repellant spray within the container such that the user can insert his hand into the container to engage the weapon and after insertion of the user's hand, the container can be locked so that an assailant cannot take the hand weapon away from the user.

SUMMARY OF THE INVENTION

The present invention involves a locking container for a hand weapon, such as a stun gun or liquid repellant s, pray, where the container is designed to prevent an assailant from taking the hand weapon away from the user or wearer. The locking container is adapted to encircle the hand of the wearer or user up to the wrist portion thereof. The container is provided with an open end through which the hand is inserted and an opposite end which is closed by a transverse plate. The hand weapon is mounted within the container by means of a bracket which attaches the hand weapon to the transverse plate. The transverse plate is provided with an opening which will cooperate with the discharge end of the hand weapon such that the discharge end can be directed towards a possible assailant. The container is so designed that the hand can be inserted into the container and the hand can grasp the weapon and position a finger of the hand against the trigger of the weapon.

A locking device, such as one-half of a set of handcuffs, is mounted at the open end of the container for locking against the wrist of the wearer after the hand is inserted into the container. The handcuff can be metal or plastic. Where the handcuff is metal, it is welded to an arcuate metallic plate which, in turn, is connected to the container at the open end thereof.

In one embodiment of the present invention, the container is a rigid sleeve of transparent plastic material which can be molded as a one-piece item along with the transverse plate.

In another embodiment of the present invention, the container is made of cloth material which is flexible and is generally non-transparent. A further embodiment involves the replacement of the cloth material with a sheet of flexible transparent plastic material of the same shape as the cloth material.

In another embodiment of the present invention, the container is formed as an open web made of flexible cords which could also be reinforced.

In both the web and cloth versions, the container is provided with a rigid plastic trigger guard.

In still a further embodiment of the present invention, the container is provided with a cylindrical extension which is long enough to cover the arm of the wearer up to the elbow thereof. In this embodiment, both the extension and the container are provided with shard spikes projecting out of the peripheries thereof around the outer aspect of the arm of the wearer for approximately 190 degrees around the peripheries of the container and the extension. In this "long" embodiment, the extension is attached to the container through the handcuff which is welded to a pair of arcuate metallic plates connected to the container and extension, respectively.

DETAILED DESCRIPTION OF THE PREFERRED EMBODIMENT

Figure 1:
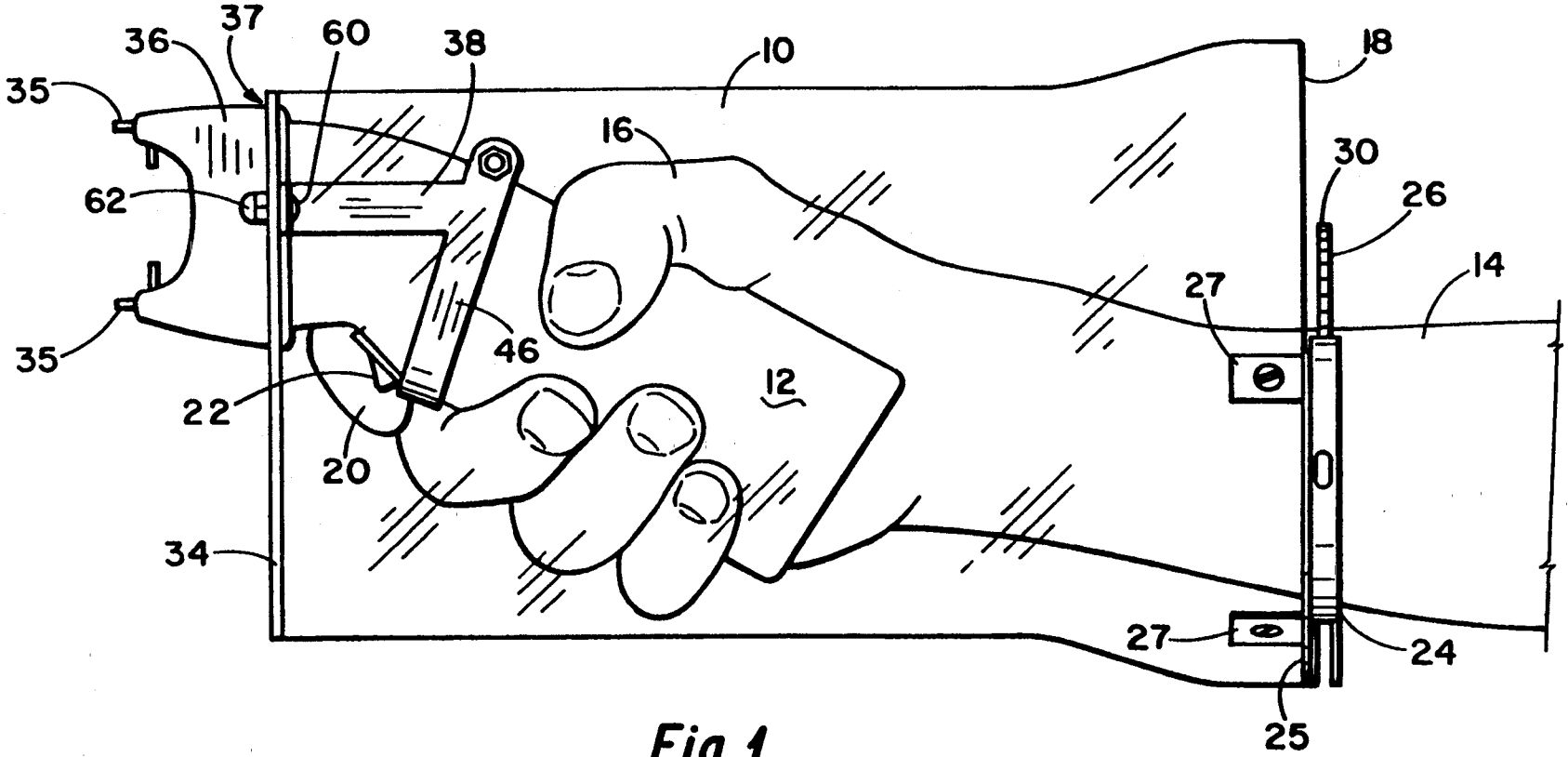
FIG. 1 is a side elevation of a locking container constructed according to a preferred embodiment of the present invention wherein the container is made of a hard, transparent plastic material and wherein components located within the container are visible through the side of the container.
Figure 3:
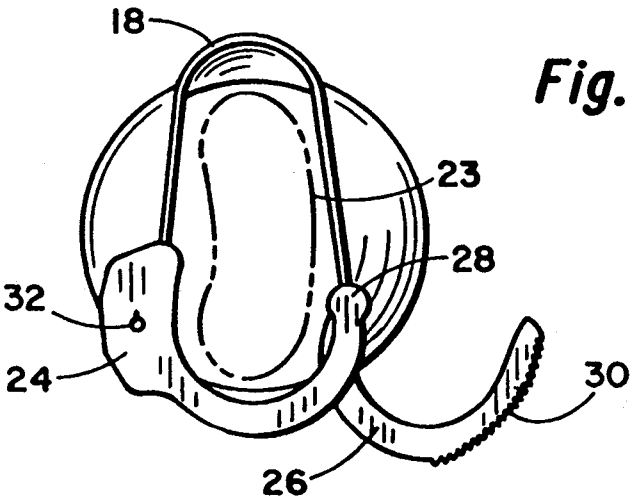
FIG. 3 is a rear end view of the locking container as viewed along line 3—3 of FIG. 2.
Figure 2:
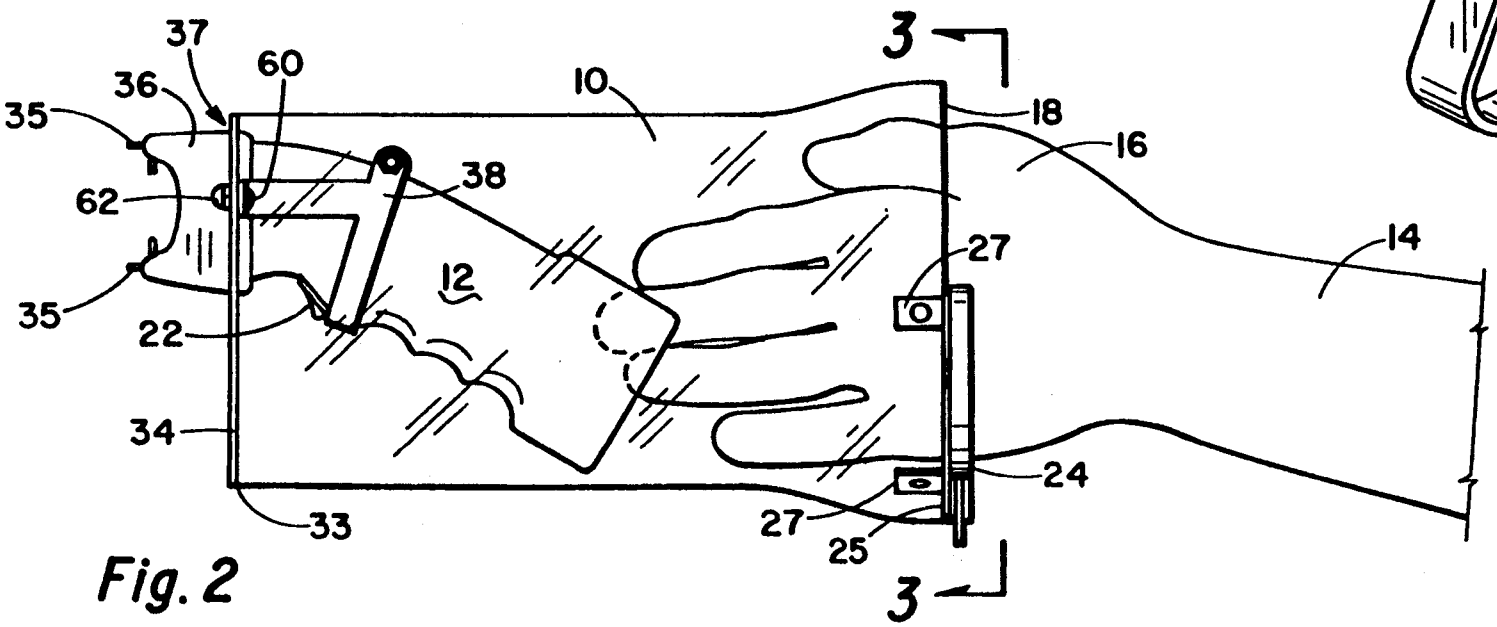
FIG. 2 is a view similar to FIG. 1 showing the user or wearer introducing his hand into the container.
Figure 14:
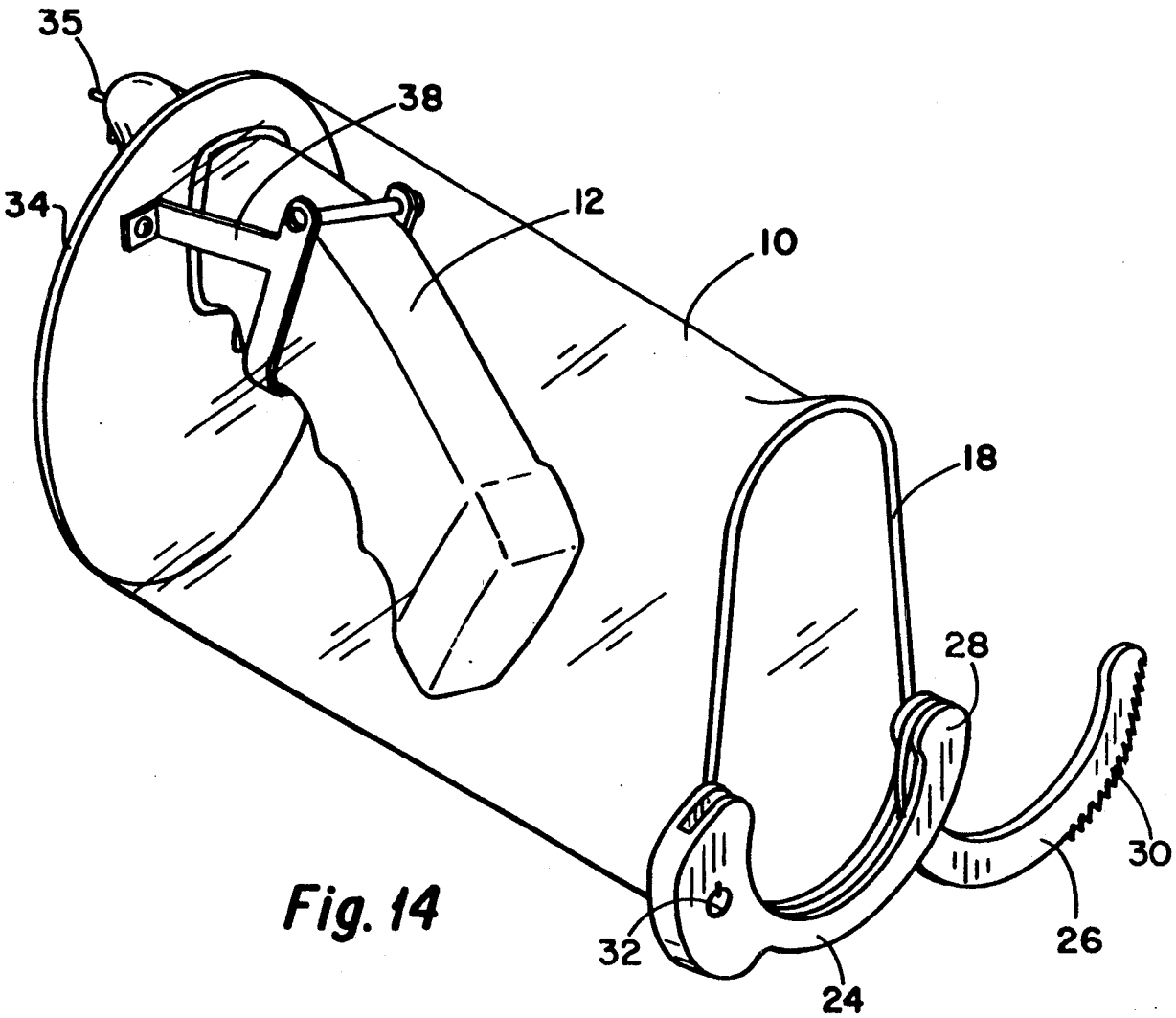
FIG. 14 is a perspective view of the locking container shown in FIG. 1 with the hand of the user removed.

Referring to the drawings in detail, FIG. 1 shows a locking container 10 for a hand weapon 12, in this case a stun gun. In FIG. 1, an arm 14 of a user or wearer (not otherwise shown) is shown extending into a right-hand end 18 of the container 10 and a right hand 16 of the wearer is shown in gripping engagement with a handle or hand portion of the stun gun 12. FIG. 2 shows the wearer in the act of inserting his hand 16 into the right-hand end 18 of the container 10. The hand 16 is necessarily in a straightened position in accordance with the dotted line representation 23 in FIG. 3 so that the hand 16 can enter into the right-hand end 18 of the container 10 to reach the position shown in FIG. 1 such that a forefinger 20 of the hand 16 is adapted to engage a trigger 22 provided on the stun gun 12. As best shown in FIGS. 3 and 14, the right-hand end 18 is an opening in the shape of a long oval with the bottom portion being somewhat wider than the top, almost like an elongated egg and serves as a hand entrance opening for the container 10.

In order to lock the wearer's hand 16 inside the container 10, a handcuff 24 is attached to the right-hand end 18 of the container 10 and is designed to lock around or encircle a wrist of the wearer's hand 16. The handcuff 24, which can be considered as essentially conventional, is provided with an arcuate member 26 which pivots or swings around the pivot end 28 and which is provided with ratchet teeth 30. The ratchet teeth 30 are adapted to engage an internal pawl (not shown) within a body of the handcuff 24 when the arcuate member 26 is swung in a counter-clockwise direction (as it relates to FIG. 3) around a wrist of the wearer. In order to release the arcuate member 26 from the body of the handcuff 24, it will be necessary to insert a key (not shown) into a keyhole 32 to release the pawl (not shown).

A left-hand end 33 of the container 10 is provided with a vertical or transverse plate 34. A discharge end 36 of the stun gun 12 is adapted to project through an opening 37 in the plate 34 such that the opening 37 is the same size and shape as the end 36 of the stun gun 12. The discharge end 36 of the stun gun 12 is provided with suitable electrodes 35 such that when the trigger 22 is depressed, the gun can deliver several thousands of volts of energy to the person or thing with which the electrodes 35 come in contact.

Figure 4:
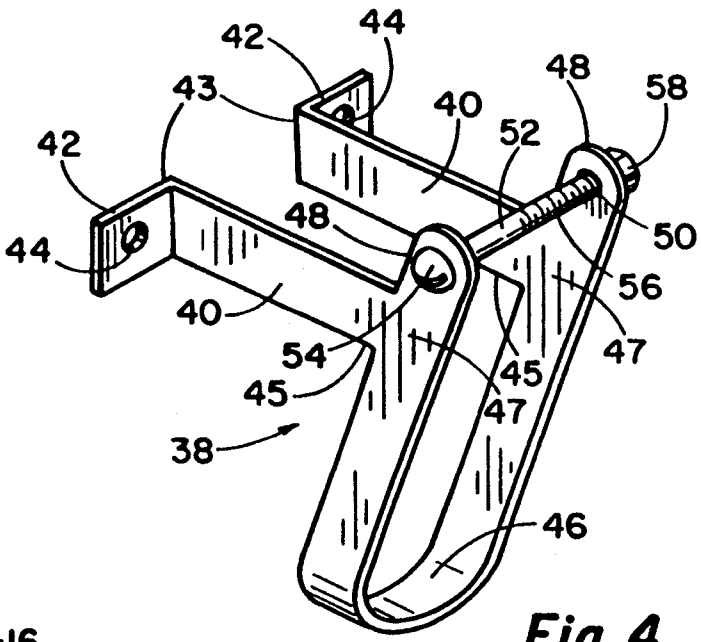
FIG. 4 is a perspective view of the bracket used to hold the stun gun to the inner, forward end of the locking container.

A bracket 38 (see FIG. 4) is provided for holding the stun gun 12 in position against the plate 34. This bracket 38 includes a pair of spaced horizontal arms 40 having right angled portions 42 at their forward ends 43. The right angled portions 42 are provided with holes 44 for a purpose which will hereinafter appear. Rear ends 45 of the arms 40 connect with a U-shaped member 46 which extends downwardly below the arms 40. Upper ends 47 of the U-shaped member 46 are provided with extensions 48 through which holes 50 are provided. A bolt 52 having a head 54 at one end and a threaded portion 56 at an opposite end extends through the holes 50 as shown in FIG. 4. A threaded nut 58 is received in the outer projecting threaded end 56 so that the bolt 52 can be tightened. As shown in FIGS. 1 and 2, the lower end of the U-shaped member 46 is adapted to engage the handle of the stun gun 12 just below or behind the trigger 22. The nut 58 can be tightened so that the U-shaped member 46 securely embraces the handle of the stun gun 12. Short bolts 60 (only one of which is shown in FIGS. 1 and 2) pass through the holes 44 located in the bracket 38 and through corresponding holes provided in the plate 34. Cap nuts 62 (only one of which is shown in FIGS. 1 and 2) are screwed on the outer ends of the short bolts 60 to hold the stun gun 12 firmly in the position shown in FIGS. 1 and 2.

The container 10 is preferably made of rigid plastic and transparent material, such as PLEXIGLASS ® or clear plastic. The forward plate 34 is also preferably of hard, transparent material. The plate 34 can be attached to the container 10 by any suitable glue or cement or, preferably, the container 10 and plate 34 can be molded as a one-piece item. The container 10 and plate 34 are also preferably electrically non-conductive.

FIG. 14 is a perspective view of the locking container shown in FIG. 1 with the hand of the user being removed and the handcuff 24 being in the open position.

Figure 6:
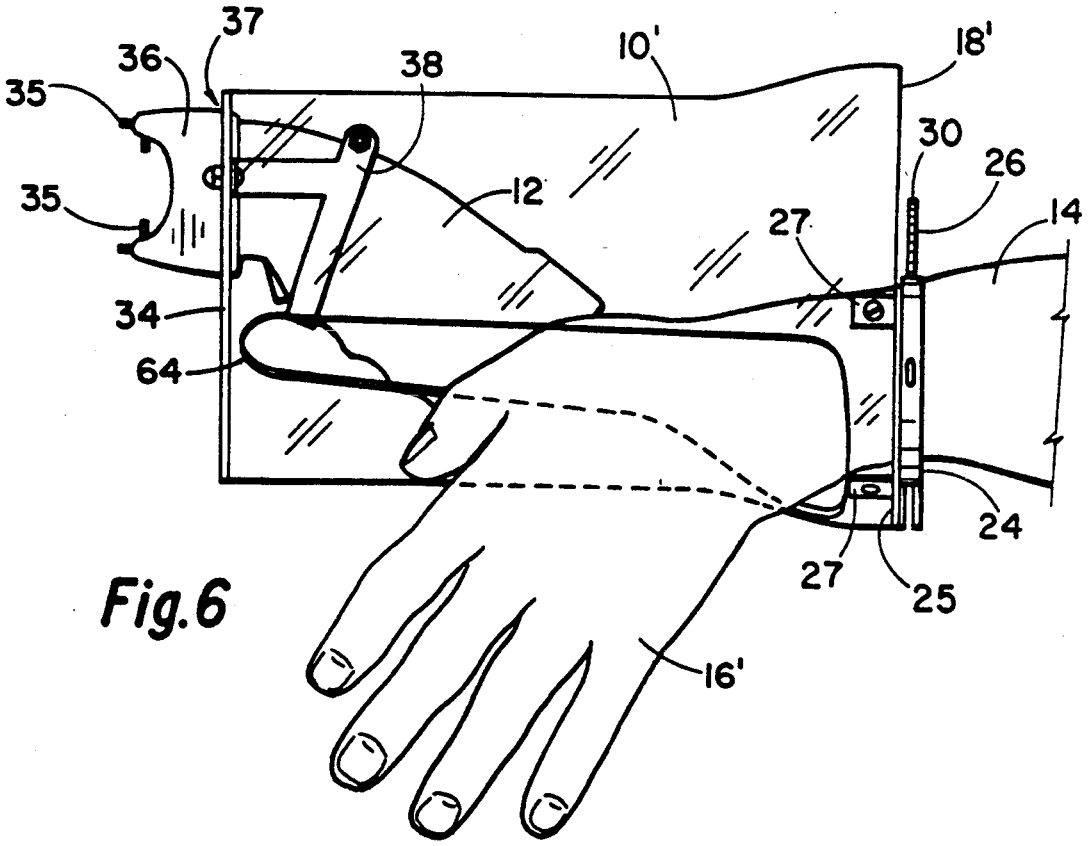
FIG. 6 is a view similar to FIG. 5 showing the hand of the user reaching out through the slot in the modified form of the locking container.
Figure 5:
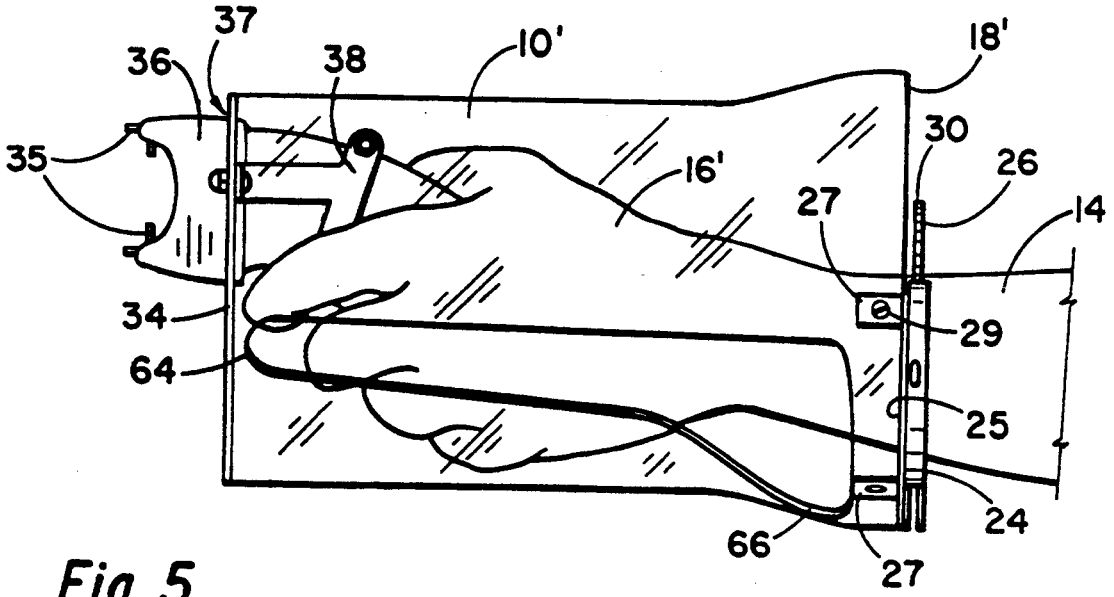
FIG. 5 is a view similar to FIG. 1 showing a modified form of the locking container.

The embodiment shown in FIGS. 5 and 6 is similar to the one shown in FIGS. 1 through 4. However, a container 10′ shown in FIGS. 5 and 6 is designed for left-hand wearing and is further provided with an elongated hand-shaped opening 64 which is located at a lower side of the container 10′ and which allows a left hand 16′ to very quickly exit the container 10′ and to re-enter the container 10′ without having to unlock and remove the container 10′. As shown in FIGS. 5 and 6, the elongated opening 64 is narrow at the left-hand or forward end and is provided with an enlarged portion 66 at a right-hand or rear end. In order to exit the opening 64, the left hand 16′ must be released from the handle of the stun gun 12 and moved rearwardly slightly in order for the hand 16′ to fit through the opening 64. The left hand 16′ and the fingers must be in a straightened position to fit through the opening 64.

The handcuff 24 with its arcuate locking member 26 is preferably one-half of a set of conventional metal handcuffs. However, the handcuff 24 could be made of hard plastic material, as there are such handcuffs in the marketplace. A plastic handcuff could be used, instead of a metal handcuff, by molding the plastic handcuff to the right-hand end 18 or 18′ of the container 10 or 10′ as the container is molded during manufacture. When the handcuff 24 is made of metal, as shown in FIGS. 1 through 6, an arcuate metallic plate 25 is provided; this arcuate metallic plate 25 attaches to the right-hand end, either 18 or 18′, of the container, either 10 or 10′, by means of right angled tabs 27 in the arcuate metallic plate 25. Screws 29, bolts and nuts (not shown), or other suitable attachment devices (not shown) can be used to attach the plate 25 through convenient holes (not shown) provided in the right-hand end 18 and also provided in the tabs 27. The handcuff 24 is welded to the plate 25 before the plate 25 is attached to the container 10.

Figure 7:
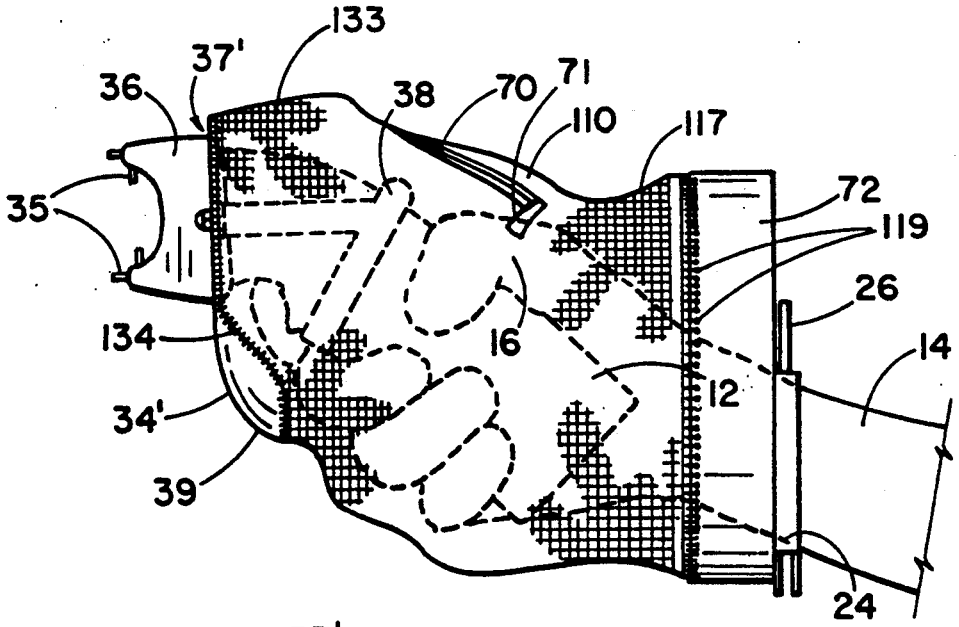
FIG. 7 is a side elevation of another modification of the locking container with certain hidden pans shown by dotted lines.
Figure 8:
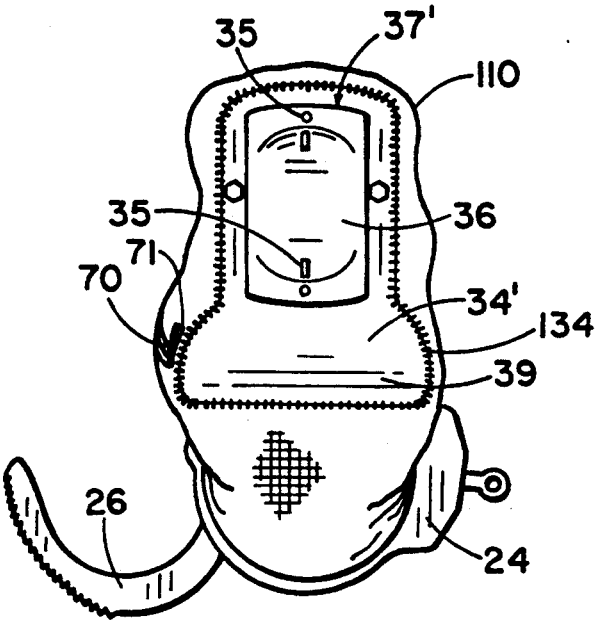
FIG. 8 is a front end view taken from the left side of FIG. 7.
Figure 9:
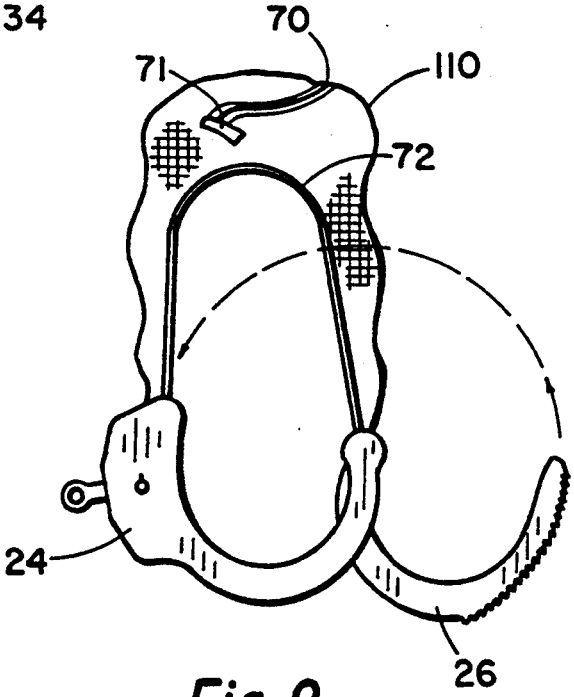
FIG. 9 is a rear end view taken along the right end of FIG. 7.

FIGS. 7, 8 and 9 show a container 110 which is made of flexible material such as cloth. The embodiment of FIGS. 7, 8, and 9 is sometimes referred to as a "mitten" version. The flexible material can and does compact, which makes it convenient for a woman to carry in her purse or handbag since it takes up less room. This container 110 is for wearing on the right hand 16 and is provided with an elongated opening (not shown) closably by means of a zipper 70. The zipper 70 is provided with a tab (not shown) which can be accessed by the thumb and finger of the hand 16 only from the inside of the container 110. The tab (not shown) can be pulled along the zipper 70 to open and close the elongated opening (not shown). This "inward facing" zipper 70 is preferably sewn or stitched to the flexible material of the container 110. Obviously, this version can be designed for wearing on the left hand by making a mirror image thereof. When the zipper 70 is unzipped, this allows the hand 16 to exit the container 110 without unlocking and removing the container 110 from the hand 16. A right-hand end 117 of the container 110 is connected or sewn to a series of holes 119 of the metallic oval ring 72. The right-hand end 117 is shaped essentially the same as the right-hand end 18 of the container 10 shown in FIG. 3. The metallic handcuff 24 is preferably welded to the metallic oval ring 72 and the arcuate member 26 opens in the same manner as previously described. A forward or left-hand end 133 of the container 110 is connected or sewn to a series of plate holes 134 in a plate 34'. The plate 34' is essentially the equivalent of the plate 34 shown in FIGS. 1 and 2. The same bracket 38 is used to attach the stun gun 12 to the plate 34' in the same manner as described above for plate 34. The forward end or discharge end 36 of the stun gun 12 projects outwardly from a hole 37' in the plate 34' in the same manner as described above in relation to FIGS. 1 through 4. A lower end 39 of the plate 34' is curved downwardly and rearwardly to serve as a trigger guard.

Figures 10, 11:
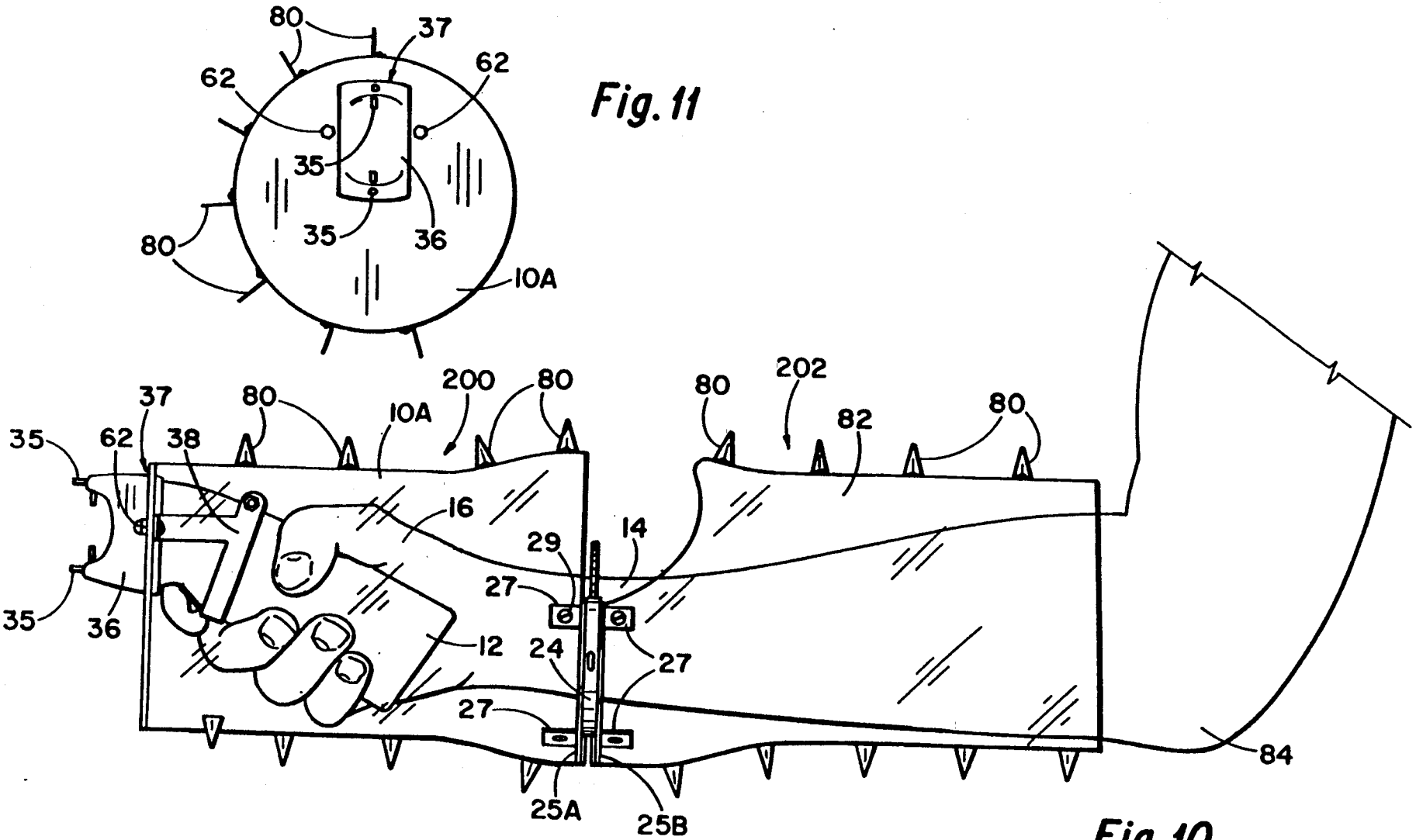
FIG. 10 is a side view of a modified form of the locking container provided with an extension.
FIG. 11 is a front end view taken from the left side of FIG. 10.

FIGS. 10 and 11 represent a "long" version or embodiment of the invention. A left-hand portion 200 is provided with a container 10A which is the same as the container 10 shown in FIGS. 1 and 2, except that a periphery of this container 10A is provided with spikes 80 which are pointed as shown at a tip and are sharp along both inclined edges leading to the tip in order to prevent or deter someone from physically grabbing the container 10A. The embodiment of FIG. 10 is provided on a right-hand portion 202 with a cylindrical extension 82 which is long enough to cover the arm 14 of the wearer up to an elbow 84. A periphery of the extension 82 is also provided with spikes 80. In this regard, it should be pointed out that the spikes 80 are located on the outer aspect of the arm 14 of the wearer for about 190 degrees around the periphery of the container 10A and around the periphery of the extension 82, as best shown in FIG. 11. The remaining portions of the peripheries of the container 10A and the extension 82 are located adjacent a body of the user and this portion is free of spikes 80 in order that the user not stab himself.

In the case of this FIG. 10 embodiment, the extension 82 is attached to the container 10A through the handcuff 24. In this regard, the handcuff 24 is provided with two arcuate metallic plates 25A and 25B welded to either side of the handcuff 24. As shown in FIG. 10, the left-hand arcuate metallic plate 25A is attached to the container 10A in the same manner as previously described for container 10 and arcuate metallic plate 25. The right-hand arcuate metallic plate 25B is likewise provided with right angled tabs 27 and is attached to the cylindrical extension 82 by means of the tabs 27 and suitable screws 29, bolts and nuts (not shown), or other suitable attachment devices (not shown) which extend through holes (not shown) provided in the cylindrical extension 82 and provided in the tabs 27.

Figure 12:
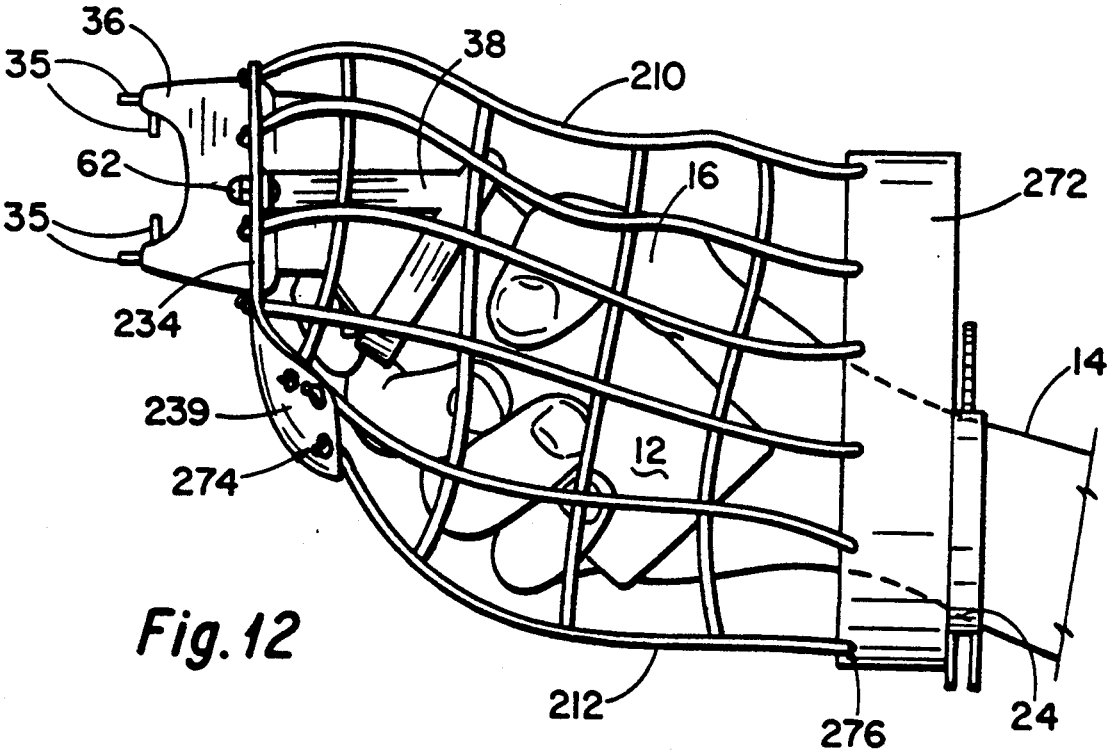
FIG. 12 is a side view of another modified form of the locking container.

The embodiment shown in FIG. 12 is similar to the cloth version shown in FIG. 7. However, container 210 of FIG. 12 is different from the container 110 of FIG. 7 in that the 210 container is an open web made from flexible cords 212 which are attached to a forward plate 234 and a rear metallic oval ring 272. The flexible cords 212 are attached to the forward plate 234 and attached to the ring 272 by placing one end of each of the flexible cords 212 through individual holes 274 provided in the plate 234 and placing opposite ends of the flexible cords 212 through individual holes 276 of the ring 272, and knotting the ends of the flexible cords 212, as shown in FIG. 12. The handcuff 24 is welded to the ring 272. A lower end 239 of the plate 234 is curved shaped to form a trigger guard to prevent an assailant from attempting to squeeze the forefinger 20 of the wearer and thereby actuating the trigger 22. For extra security against the web 210 being cut with a knife by an assailant attempting to forcibly remove the container 210 from the wearer's hand 16, the cords 212 could have flexible wire cores (not shown) to make the web 210 more difficult to cut.

Figure 13:
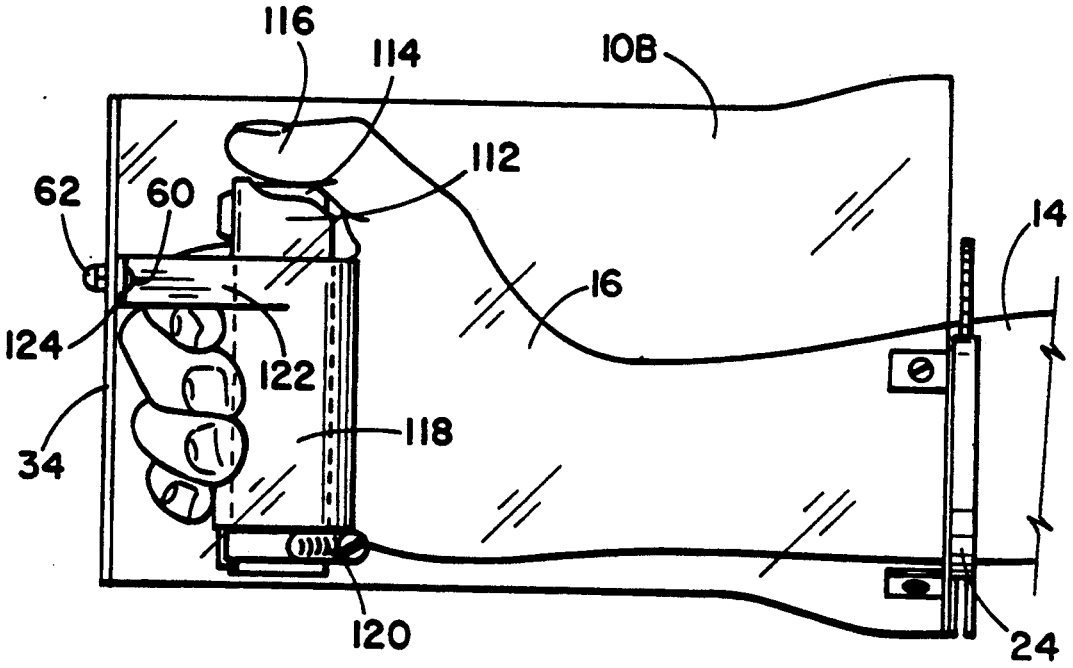
FIG. 13 is a view similar to Figure I when the stun gun and its bracket have been replaced with a repellant spray device and its supporting attachment.
Figure 15:
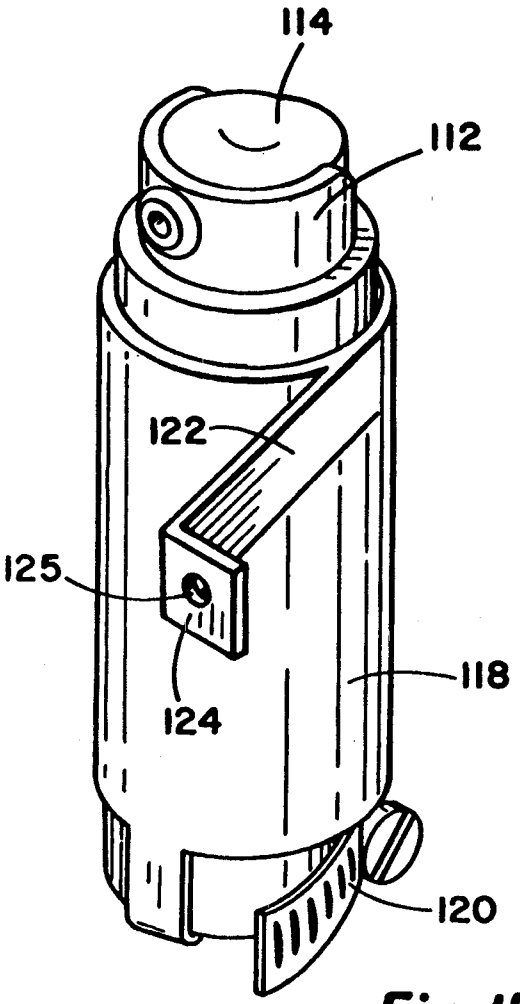
FIG. 15 is a perspective view of the repellant cylinder shown in FIG. 13 together with its supporting attachment.

FIG. 13 shows a locking container 10B provided with a liquid cartridge 112 filled with a liquid repellant such as MACE ®. Referring also to FIG. 15, repellant cartridge 112 is provided with a trigger or button 114 which is easily accessed by a thumb 116 on the hand 16. The cartridge 112 is supported in a cylindrical holder 118, a bottom end of which is provided with a hose clamp attachment 120 which can be tightened so as to secure against a bottom end of the cartridge 112. The cylindrical holder 118 is provided with a horizontal arm 122 with a right angle tab 124. A single short bolt 60 passes through a hole 125 in the tab 124 and through one of the holes in the forward plate 34. An external end of the bolt 60 is secured by a cap nut 62.

FURTHER DESCRIPTION OF THE PREFERRED EMBODIMENTS

A hand weapon, used in conjunction with the present invention, cannot easily be taken away from the wearer by an assailant. To do so, the handcuff must be unlocked, and the container forcibly removed from the wearer's hand.

Also, the weapon cannot be accidentally dropped, nor can the weapon be knocked out of the hand during an assault.

Also, gaining access to the activation means of the weapon, (such as the trigger of the stun gun) is extremely difficult for an assailant to accomplish. The various versions of the invention are designed so that an assailant does not have ready access to the trigger of the stun gun.

The hard shell versions (FIGS. 1 through 6, 10, 13 and 14) totally enclose the trigger. The web version (FIG. 12) and the mitten version (FIG. 7) have a trigger guard, which helps to prevent trigger access by an assailant.

This invention does, by its nature, serve to increase the legitimate defense potential and ability of individuals, and this invention is generally undesirable for use in criminal acts.

All versions of this invention are used in combination with a weapon. The combination of the two (the container and the weapon) has greater size, and greater visibility, than a weapon used singularly. Persons who are intent on committing a criminal act, whatever that act may be, generally use a weapon that can be easily concealed, since other persons might see the weapon and notify law enforcement authorities. The use of this invention, with a weapon, is difficult to conceal, and therefore, it is difficult to carry the weapon surreptitiously.

A weapon, by itself, is often carried surreptitiously by criminals by hiding the weapon underneath their clothing. This invention, when used with a weapon, produces a larger bulge underneath the clothing than concealing a weapon does without the use of this invention. This factor can make use of this invention undesirable to criminals.

Also, this invention, which is locked onto the wearer's hand, is not designed to be removed quickly from the wearer's hand. Therefore, the weapon inside the container, and the container itself, cannot be disposed of as quickly as disposal of a singularly used weapon. Since a criminal sometimes finds it advantageous to dispose of a weapon in a quick and timely manner in order to avoid suspicion, apprehension or proof of his guilt, use of this invention could be a disadvantage to a criminal.

On the other hand, a person who uses a weapon for defensive purposes has no need of quickly disposing of a weapon, nor a need to efficiently conceal the weapon. The use of this invention with a weapon makes it more difficult to dispose of the weapon and makes it more difficult to conceal the weapon.

The hard shell versions of this invention are made of a hard and transparent material, such as PLEXIGLASS® or clear plastic. Use of a transparent material allows the weapon itself to be visible to other persons when the weapon is inside the hard shell versions. This factor is another reason why the hard shell versions are generally not advantageous for use in criminal acts. The clear and transparent hard shell versions do not conceal the weapon inside.

Another purpose/advantage of all versions of this invention is that, since it is locked onto the wearer's wrist, the container (and therefore the weapon) cannot be accidently dropped from the wearer's hand. This factor can be beneficial, as an example, for a woman who is running away from an assailant.

Another advantage of the transparent hard shell versions and the web version is the increased visibility of the weapon to assailants. Assailants would see the weapon inside the container and realize the increased defensive ability of the wearer. Therefore, assailants would have more reason to leave the wearer alone. (The cloth of the container of the mitten version shown in FIG. 7 could be replaced with a clear, flexible, transparent plastic material. If so, the above factor would apply to the mitten version also.)

The hard shell versions provide protection for the wearer's hand. If an assailant delivers blows to the hard shell container, the wearer's hand is protected by the hard shell container.

An advantage of all of the versions of the container is that the wearer's hand does not need to maintain a constant grip on the weapon. Without the use of the container, the hand can tire from continuously gripping the weapon in order to be able to use the weapon immediately. With the use of the container, the hand can relax, yet the ability to immediately use the weapon still exits. This is advantageous when a long period of time is involved. The wearer's hand can be at his or her side, with the hand inside the container relaxed, not gripping the weapon, and the container remains on. The locked handcuff makes this possible, as does the shape of the hand entrance opening if the handcuff is unlocked.

The shape and design of the hand entrance opening requires the user of the container to straighten his hand and fingers (as shown in FIG. 2) in order to insert the hand through the hand entrance opening, and into the container. The size and design of the hand entrance opening is such that, when the container is worn, there is not enough space for an assailant's hand to also fit through in an attempt to access the trigger.

Another purpose of the hand entrance opening is as an extra security measure, or a sort of "back-up", to help prevent the container from being pulled off the wearer's hand by an assailant, or the container being knocked off the wearer's hand by an assailant if the handcuff is not locked. For example, if an assailant rushed towards the person who is in the act of putting the container onto his or her hand, there may be only enough time to insert the hand into the container, and not enough time to be able to lock the handcuff on, before the assault begins. In this situation, the wearer's hand inside the container, and the hand being in a "spread out" position, tends to make the container stay on the hand, since the hand must be in the straightened out position for the hand to come out. Even with the handcuff unlocked, it is somewhat difficult for an assailant to pull the container off the wearer's hand. Also, the container tends to stay on, even with the handcuff being unlocked, if the wearer's hand is knocked about during a struggle.

Ideally, the optimum size of the hand entrance opening is only large enough to permit the hand to enter, with practically no extra space. This enhances the ability of the container to stay on, when the handcuff is unlocked. Various sizes of hand entrance openings, such as small, medium and large sizes, could be manufactured, so that an individual could have a container that has the optimum sized hand entrance opening for his or her size of hand. To make the FIG. 5 version fully functional for wearing on either the right or left hand, a second side hand opening (not shown) could exist. It would be located on the opposite side and shaped to allow the right hand to exit. Or, to accommodate the wearing of the container on the right hand, the container could have only one side hand opening, shaped for the right hand to fit through and located oppositely (not shown).

The stun gun, and/or the spray cartridge, cannot be pulled out of the front opening of the container by an assailant, even if the cap nuts are unscrewed. The stun gun, bolted to the bracket, cannot fit through the front opening. The spray cartridge, clamped to the cylindrical holder, cannot fit through the front opening either.

The attachment bracket for the stun gun is designed for this particular shape of stun gun, but the attachment bracket shape could be designed to fit other shapes of stun guns (not shown), or, attachment brackets could be designed to fit other various weapons (not shown), for example, knives, hand guns, etc.

The cylindrical holder, used for and with spray cartridges, does accommodate various sized spray cans or cartridges. The length of the cylindrical holder is purposefully smaller than the length of most commercially available spray cartridges. The cylindrical holder is made short so that the dispensing nozzles of even the smaller length spray cartridges are above the top edge of the cylindrical holder. This ensures that the nozzle area is not blocked by the cylinder wall and, therefore the spray has a "clear shot" out of the front opening. Also, since the cylindrical holder is open at both its top and bottom ends, various lengths of spray cartridges are accommodated.

The diameter of the cylindrical holder is larger than the diameter of most commercially available spray cartridges, so cartridges of various diameters will fit into the holder. The spray cartridge is placed and properly positioned in the holder so that the dispensing nozzle will be directed towards the front opening of the container. After the cartridge is placed inside the holder, the hose clamp attachment is sufficiently tightened, which secures the cartridge snugly against part of the holder's wall. Then, the holder and attached cartridge are placed inside the container and bolted into place.

The cylindrical holder has just one horizontal arm as an attachment member to attach the holder to the container. Using only one member allows the hand to have a totally natural grip on the holder. However, two members could be used, so that the holder is more securely attached to the container (not shown). A person can still effectively grip a holder that has two members by gripping the holder with their hand located at a slightly lower location on the holder.

When the battery of the stun gun needs to be replaced, the cap nuts are unscrewed so the bracket and the stun gun can be removed through the hand entrance opening. A new battery is installed, and then the stun gun and bracket are re-installed inside the container. The same procedures apply to replacing a spent spray cartridge.

An advantage of using a standard handcuff as the locking means of the container is that, if the handcuff is locked (before it is on the wrist), it does not need to be unlocked with a key before it can be used. When the handcuff is locked before it is placed on the wrist, the arcuate member of the handcuff can be rotated in the direction of the internal pawl, which unlocks the handcuff. This factor is advantageous, as an example, when the container is carried in a woman's purse or handbag, and the handcuff of the container becomes locked due to being jostled or moved about in the handbag. The arcuate member of the handcuff can be quickly rotated (no need to take time to unlock the handcuff with the key) to an unlocked position so the container can be quickly put onto the hand and locked.

On all versions, the keyhole of the handcuff is located on the proper side (either left side or right side), for the particular container. For example, the hard shell container of FIG. 5 with a hand-shaped opening is designed to be worn on the left hand. So the keyhole of the handcuff is located at the inside, i.e., the side of the container adjacent the wearer's body, of the container so it is easier to access and unlock the handcuff with the right hand.

The hard shell versions, and the mitten version that can be made with an optional flexible plastic material, could be provided with numerous small air holes (not shown) to allow for increased air circulation to the hand. This ventilation could be desirable when the container is worn for long periods of time or when it is worn outdoors in warm or hot weather.

The interior area of the hand entrance opening, this being the area that makes contact with the wearer's wrist, could have padding (not shown) to make the container more comfortable to wear for long periods of time.

The version of FIGS. 5 and 6 is designed for left hand wearing. The long, hand-shaped opening at the lower side is designed and shaped to allow the left hand to very quickly exit the container, and/or re-enter the container, without having to unlock and remove the container. The hand and fingers must be in a straightened position to fit through this opening. When the hand is grasping the stun gun (or the spray cartridge), the hand cannot exit through this opening. It would be extremely difficult for an assailant to pull the wearer's hand out through this opening.

Ideally, the optimum size of this hand-shaped opening is only large enough to allow the hand to fit through although the size does not need to be optimum to function properly. This factor makes it even more difficult for an assailant to reach in in an attempt to pull the wearer's hand out. Also, this makes it more difficult for an assailant to access the trigger through this opening.

The optimum size of this hand-shaped opening correlates to the optimum size of the hand entrance opening. Ideally, a person would be able to purchase a container with both hand openings being the optimum sizes, these sizes being only large enough to allow his or her hand to fit through the openings. Or, various standard sizes could be manufactured, such as small, medium and large sizes.

This version is suitable to be worn on the left hand of a right-handed law enforcement officer. This allows the right hand of the officer, the right hand being the "gun hand", to remain free and unencumbered, so the officer always remains capable of drawing his or her handgun.

Since the hand is able to exit or re-enter the side opening of this version very quickly, an officer can wear this container but still retain the ability to use both hands. The use of both hands is often necessary for various tasks, and for the personal safety of the officer.

The embodiment of FIGS. 7, 8, and 9, referred to as a "mitten" version or a flexible container version, is equipped with a zippered opening which allows the wearer's hand to exit or re-enter this version, without having to unlock and remove the container. The zipper faces inward, so that it is zipped open or closed by the wearer's hand located inside the flexible container. Due to this factor, an assailant cannot unzip the zipper to gain access to the container's interior.

The "long" version which is provided with external spikes (FIG. 10) could be especially advantageous for use by prison guards and jailers. They sometimes have to be among prisoners without a weapon for their own self-protection primarily due to the possibility of the weapon being taken by the prisoners. The spikes deter prisoners from physically grabbing the container in an attempt to remove the container or to stop the use of a weapon contained therein. Also, the spikes could be used defensively by the jailer if attacked by prisoners.

In an attempt to stop and/or prevent the wearer from using this version, the upper arm of the wearer (the area between the elbow and the shoulder) could be grabbed and restrained, or pinned down, since that area of the arm is not covered by the cylindrical extension and the spikes attached thereto. If this occurs, the wearer can still bend his or her arm at the elbow, thereby allowing freedom of movement of the forearm and hand which allows the wearer to effectively use the weapon.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A locking container for a hand weapon comprising a longitudinally extending container having an open end and an opposite closed end, a transverse plate mounted at the closed end of the container, a hand weapon mounted within the container and connected to the transverse plate by means of a bracket, the hand weapon having a discharge and adapted to be utilized against an assailant, the transverse plate being provided with an opening cooperating with the discharge end of the hand weapon whereby the discharge end can be directed against the assailant, the open end of the container being adapted to receive a hand of a user of the hand weapon such that the hand can be inserted into the container to grasp the hand weapon and so as to position a finger of the hand against a trigger of the hand weapon, and a locking device mounted on the open end of the container adapted to encircle a wrist of the user and lock the hand within the container and thereby prevent an assailant from taking the hand weapon away from the user.

2. The improvement according to claim 1 wherein the container is a rigid shell of transparent plastic material.

3. The improvement according to claim 1 wherein the container is made of cloth material.

4. The improvement according to claim 3 wherein the transverse plate has a lower end which forms a trigger guard.

5. The improvement according to claim 3 wherein the container is provided with an elongated opening which is normally closed and can be repeatedly opened and reclosed by means of a zipper attached to the elongated opening, said zipper having operating means and an inwardly facing tab attached to the operating means so that the tab is accessible by fingers of the user from inside the container in order that the user can operate the zipper to open the elongated opening allowing the hand to exit the container and to re-enter the container after which the wearer can operate the zipper to reclose the elongated opening.

6. The improvement according to claim 1 wherein the container is an open web.

7. The improvement according to claim 6 wherein the transverse plate is provided with a lower end which forms a trigger guard.

8. The improvement according to claim 1 wherein the hand weapon is a stun gun whose discharge end projects out through the opening provided in the transverse plate and wherein the bracket includes a pair of spaced horizontal arms having forward ends connected to the transverse plate and having rear ends which connect with a U-shaped member, the U-shaped member having a bottom portion which engages a stun gun behind the trigger thereof, the U-shaped member having upper ends which are connected by a bolt which can be tightened such that the bracket firmly engages the stun gun.

9. The improvement according to claim 1 wherein the hand weapon is a cartridge containing liquid repellent and wherein the bracket consists of a cylindrical vertical tube holder having means thereon for securing the repellant cartridge, the holder having at least one horizontal arm which extends forward and connects to the transverse plate.

10. The improvement according to claim 1 wherein the container is provided with an elongated hand-shaped opening located at the lower side of the container which allows the hand of the wearer to very quickly exit the container and to reenter the container without having to unlock and remove the container.

11. The improvement according to claim 1 wherein the locking device is a handcuff.

12. The improvement according to claim 11 wherein the handcuff is metallic and wherein the handcuff is attached to the container by means of an arcuate metallic plate which attaches to one side of the handcuff, the arcuate metallic plate being attached to the container.

13. The improvement according to claim 12 wherein a second arcuate metallic plate is attached to the handcuff on a side of the handcuff opposite the first arcuate metallic plate, the second arcuate metallic plate being attached to an extension.

14. The improvement according to claim 13 wherein the container and the extension are provided with sharp spikes projecting out of peripheries thereof around an outer aspect of an arm of the wearer for approximately 190 degrees of the peripheries of the container and the extension.

15. The improvement according to claim 1 wherein the container is provided with a cylindrical extension which is long enough to cover an arm of the wearer to an elbow thereof, the extension being connected to the container by means of the locking device which attaches to the open end of the container and also attaches to a forward end of the extension.

16. The improvement according to claim 1 wherein the open end has a cross-sectional shape in the form of an elongated oval.

17. The improvement according to claim 1 wherein the container is provided with an elongated opening which is normally closed and is accessible from inside the container by fingers of the user so as to open this elongated opening to allow the hand of the user to exit the container and to re-enter the container after which the user can reclose this elongated opening.

* * * * *